US009528367B2

(12) United States Patent
Selman et al.

(10) Patent No.: US 9,528,367 B2
(45) **Date of Patent: *Dec. 27, 2016**

(54) SYSTEM FOR NEAR REAL TIME SURFACE LOGGING OF A GEOTHERMAL WELL, A HYDROCARBON WELL, OR A TESTING WELL USING A MASS SPECTROMETER

(71) Applicant: SELMAN AND ASSOCIATES, LTD., Midland, TX (US)

(72) Inventors: Thomas H. Selman, Midland, TX (US); Matthew J. Jennings, Midland, TX (US)

(73) Assignee: SELMAN AND ASSOCIATES, LTD., Midland, TX (US)

( * ) Notice: Subject to any disclaimer, the term of this patent is extended or adjusted under 35 U.S.C. 154(b) by 603 days.

This patent is subject to a terminal disclaimer.

(21) Appl. No.: 14/038,711

(22) Filed: Sep. 26, 2013

(65) Prior Publication Data

US 2015/0012219 A1 Jan. 8, 2015

Related U.S. Application Data

(63) Continuation-in-part of application No. 13/029,666, filed on Feb. 17, 2011, now Pat. No. 8,838,390, and a continuation-in-part of application No. 13/744,378, filed on Jan. 17, 2013, now Pat. No. 8,614,713, and a continuation-in-part of application No. 13/744,382, filed on Jan. 17, 2013, now Pat. No. 8,682,586, and a (Continued)

(51) Int. Cl.

| | |
|---|---|
| ***E21B 47/06*** | (2012.01) |
| ***E21B 49/00*** | (2006.01) |
| ***E21B 47/00*** | (2012.01) |

(52) U.S. Cl.

CPC ..... *E21B 47/06* (2013.01); *E21B 49/005* (2013.01); *E21B 47/00* (2013.01)

(58) Field of Classification Search

None

See application file for complete search history.

(56) References Cited

U.S. PATENT DOCUMENTS 2,752,777 A 10/1950 Jacobs et al.
2,752,776 A 4/1954 Kapff et al.

(Continued)

FOREIGN PATENT DOCUMENTS

WO 9641066 12/1996

*Primary Examiner* — Alexander Satanovsky
*Assistant Examiner* — John Kuan
(74) *Attorney, Agent, or Firm* — Buskop Law Group, PC; Wendy Buskop

(57) ABSTRACT

A system for providing geological trends and real time mapping of a geological basin. The system provides in real time, information from a mass spectrometer on fluid samples from a wellbore, and forms a geochemical surface well log with graphical tracks. The system uses a dataset that includes geochemical, engineering, and geological information. The geochemical surface well log is viewable on a client device connected to a network. The geochemical well log provides information on well fluids and rocks, and displays data in graphical tracks. The mass spectrometer receives samples from a total hydrocarbon analyzer or a gas trap connected to the wellbore. The mass spectrometer performs analysis on fluid samples, and communicates in real time to the geochemical surface well log.

24 Claims, 12 Drawing Sheets

Related U.S. Application Data continuation-in-part of application No. 13/744,388, filed on Jan. 17, 2013, now Pat. No. 8,701,012.

(56) References Cited

U.S. PATENT DOCUMENTS

| | | | |
|---|---|---|---|
| 4,272,258 | A | 6/1981 | Shifflett |
| 4,358,298 | A | 11/1982 | Ratcliff |
| 4,414,651 | A | 11/1983 | Buckner |
| 4,565,086 | A | 1/1986 | Orr, Jr. |
| 4,616,321 | A | 10/1986 | Chan |
| 4,670,139 | A | 6/1987 | Spruiell et al. |
| 4,831,559 | A | 5/1989 | Miller |
| 5,058,674 | A | 10/1991 | Schultz et al. |
| 5,199,509 | A | 4/1993 | Wright et al. |
| 5,237,539 | A | 8/1993 | Selman |
| 5,329,811 | A | 7/1994 | Schultz et al. |
| 5,648,603 | A | 7/1997 | Hanson |
| 5,869,343 | A | 2/1999 | Handschuck et al. |
| 6,073,709 | A | 6/2000 | Hensley |
| 6,101,445 | A | 8/2000 | Alvarado et al. |
| 6,195,092 | B1 | 2/2001 | Dhond et al. |
| 6,496,309 | B1 | 12/2002 | Bliton et al. |
| 6,505,523 | B1 | 1/2003 | Taylor et al. |
| 6,546,818 | B2 | 4/2003 | Taylor et al. |
| 6,609,433 | B2 | 8/2003 | Taylor et al. |
| 6,666,099 | B2 | 12/2003 | Taylor |
| 6,704,656 | B1 | 3/2004 | Abriol et al. |
| 6,760,665 | B1 | 7/2004 | Francis |
| 7,099,003 | B2 | 8/2006 | Saptari et al. |
| 7,210,342 | B1 | 5/2007 | Sterner et al. |
| 7,219,541 | B2 | 5/2007 | DiFoggio |
| 7,395,691 | B2 | 7/2008 | Sterner et al. |
| 7,794,527 | B2 | 9/2010 | Sterner |
| 7,844,400 | B1 | 11/2010 | Selman et al. |
| 7,957,903 | B1 | 6/2011 | Selman et al. |
| 8,132,452 | B1 | 3/2012 | Selman et al. |
| 8,204,717 | B2 | 6/2012 | McLaughlin et al. |
| 8,214,188 | B2 | 7/2012 | Bailey et al. |
| 2003/0074139 | A1* | 4/2003 | Poedjono ..... G01V 1/34 702/16 |
| 2007/0050154 | A1 | 3/2007 | Albahri |
| 2008/0065344 | A1* | 3/2008 | Parker ..... E21B 47/00 702/127 |
| 2008/0208475 | A1 | 8/2008 | Karr et al. |
| 2008/0249790 | A1 | 10/2008 | Sinclair et al. |
| 2008/0289877 | A1 | 11/2008 | Nikolakis-Mouchas et al. |
| 2009/0132458 | A1 | 5/2009 | Edwards et al. |
| 2010/0027004 | A1 | 2/2010 | Bonyuet et al. |
| 2010/0089120 | A1 | 4/2010 | Hanson |
| 2010/0131482 | A1 | 5/2010 | Linthicum et al. |
| 2010/0175467 | A1 | 7/2010 | DiFoggio et al. |
| 2011/0048700 | A1 | 3/2011 | Van Zuilekom et al. |
| 2011/0071963 | A1 | 3/2011 | Piovesan et al. |
| 2011/0308391 | A1 | 12/2011 | DeGreeve et al. |
| 2012/0274664 | A1* | 11/2012 | Fagnou ..... G06F 3/04855 345/660 |
| 2013/0035863 | A1 | 2/2013 | Selman et al. |
| 2013/0043380 | A1* | 2/2013 | Correale ..... G01N 1/2202 250/252.1 |
| 2013/0087698 | A1* | 4/2013 | Pomerantz ..... H01J 49/26 250/254 |
| 2013/0144531 | A1* | 6/2013 | Johnston ..... E21B 44/00 702/9 |

* cited by examiner

SYSTEM FOR NEAR REAL TIME SURFACE LOGGING OF A GEOTHERMAL WELL, A HYDROCARBON WELL, OR A TESTING WELL USING A MASS SPECTROMETER

CROSS-REFERENCE TO RELATED APPLICATIONS

The present application is a Continuation in Part of co-pending U.S. patent application Ser. No. 13/029,666 filed on Feb. 17, 2011, entitled "SYSTEM FOR GAS DETECTION, WELL DATA COLLECTION AND REAL TIME STREAMING OF WELL LOGGING DATA," a Continuation in Part of co-pending U.S. patent application Ser. No. 13/744,378 filed on Jan. 17, 2013, entitled "COMPUTER IMPLEMENTED METHOD TO CREATE A NEAR REAL TIME WELL LOG," a Continuation in Part of co-pending U.S. patent application Ser. No. 13/744,382 filed on Jan. 17, 2013, entitled "SYSTEM FOR CREATING A NEAR REAL TIME WELL LOG," and a Continuation in Part of co-pending U.S. patent application Ser. No. 13/744,388 filed on Jan. 17, 2013, entitled "COMPUTER READABLE MEDIUM FOR CREATING A NEAR REAL TIME WELL LOG." These references are hereby incorporated in their entirety.

FIELD

The present embodiments relate to an automatic computer implemented system for creating a geochemical surface well log in near real time with at least one graphical drilling track for a geothermal, hydrocarbon or testing well using digital sensed data from sensors, analyzed data from analyzers, in conjunction with exploring the earth's subsurface for producible hydrocarbons.

BACKGROUND

A need exists for a system to produce an accurate geochemical surface well log in near real time that provides analysis from a mass spectrometer and provides graphical drilling tracks of the analysis information creating an executive dashboard, and operator dashboard and a well log template that is populated to become a geochemical surface well log.

A need exists for a graphical system for providing near real time surface logging information on hydrocarbon or geothermal wells using a mass spectrometer.

The present embodiments meet these needs.

BRIEF DESCRIPTION OF THE DRAWINGS

The detailed description will be better understood in conjunction with the accompanying drawings as follows.

Figure 1:
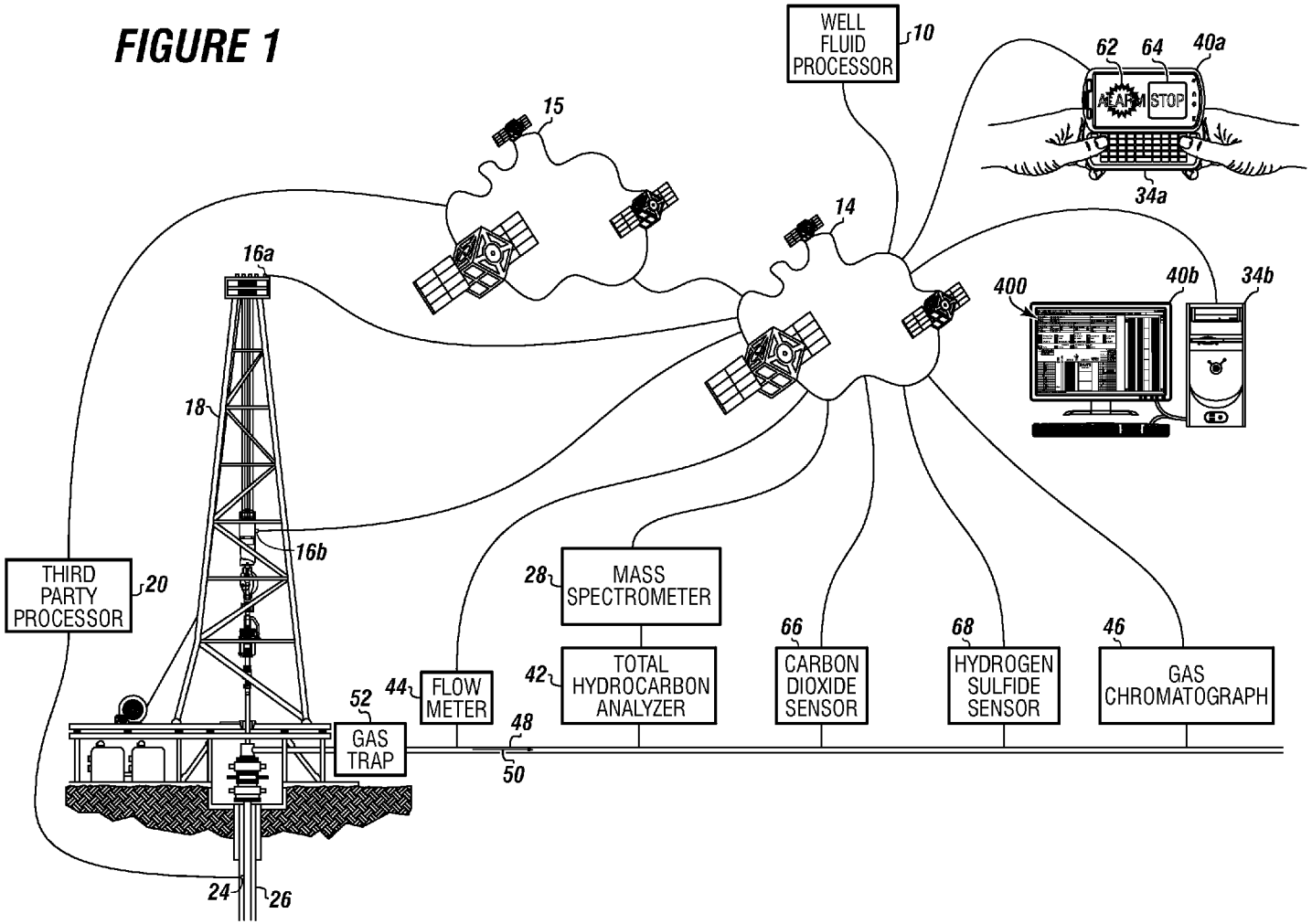
FIG. 1 depicts an embodiment of the system.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The embodiments relate to an automatic computer implemented system for providing geological trends and real time mapping of a geological basin using a mass spectrometer.

The system provides in real time, such as within a short period of time, such as within 3 seconds to 3 hours, information from a mass spectrometer on fluid samples from a wellbore, into a geochemical surface well log template to produce a geochemical surface well log with graphical tracks.

The system uses geochemical, engineering, and geological data as the dataset.

The system creates a geochemical surface well log viewable on a client device with graphical drilling tracks, that is, the geochemical well log provides information on well fluids and rock.

The system creates a well log with a macroview log plot and a microview log plot for graphically viewing the well log information.

The microview log plot has at least one of: a molecular curve, a well sensor curve, and a synthetic curve; and at least one of: a measured depth index and a measured time index.

The system creates an executive dashboard that can be viewed and used to create a customizable and changeable geochemical surface well log.

The system creates an operator dashboard usable simultaneously with the executive dashboard to view the well log information and fluid testing data.

In this system, an inline mass spectrometer receives fluid samples from a total hydrocarbon analyzer, or possibly from a gas trap connected to the wellbore. The mass spectrometer performs analysis on the fluid samples, and communicates the fluid testing analysis information in real time over a network to a well fluid processor with well fluid data storage that contains computer instructions to form and populate a geochemical well log template that forms the geochemical well log.

The communication from the mass spectrometer to the well fluid processor can be in real time, which can be within a short time, such as 3 seconds to 3 hours for insertion into a geochemical surface well log template presenting the analysis data in a plurality of graphical tracks.

The geochemical surface well log template that is populated with the analysis information from the mass spectrometer is formed using computer instructions in the well fluid data storage that specifically present in the geochemical surface well log, graphic tracks. Additional computer instructions in the well fluid data storage communicate the geochemical surface well log to a client device via a network.

Additional computer instructions in the well fluid data storage perform analysis of trends in the data of the geochemical surface well log enabling geologists and other users to map an model a geological basin in near real time is performed.

The invention prevents drilling into a geological zone that causes well fluid blowouts.

The invention can be used to accurately control the drilling of relief wells when a blown out well is on fire.

The invention is usable to prevent emission of highly toxic deadly gas over a densely populated area while drilling.

The invention can prevent drill bits from exiting the surface and leaving the target zone as an unscheduled event.

The invention allows a geologist in real time, to determine a near drilling bit lithology to stay within a target zone, negating the possibility of a drill bit exiting the target zone and possibly exiting the surface as an unscheduled event.

The invention enables the drill well fluid to be safer for workers, so that injuries and death are avoided at a well fluid site.

The embodiments can provide an early warning for the presence of dangerous toxic gas zones enabling a driller to steer away from those zones.

The embodiments enable multiple users viewing the well log to alert a driller to move away from a hazardous gas zone, so that a highly toxic gas does not harm people in a populated area.

The embodiments of the formed geochemical surface well log can be used to monitor for proper lithology proximate a drill bit while drilling in real time with up to the minute information viewable by drillers and hands at the rig.

Embodiments can reduce the exposure time for drilling into hazardous zones, by conducting drilling operation in a more accurate manner, so that injuries to workers are greatly reduced.

The system in embodiments creates a constantly updatable geochemical surface well log that shows simultaneously, a rate of penetration for the well bit, a weight on the well bit, mass spectroscopy analysis information for gas entrained in drilling fluid used while drilling the well.

The term "actual real time" as used herein can refer to instant capture of a measured item at the time of capture occurrence. The actual real time data can be gas analysis data or sensor reading data that can be provided instantly, such as within 2 seconds, to the computer readable medium as soon at the gas analysis or sensor reading is obtained.

The term "client device" as used herein can refer to a computer, a laptop, a cellular phone, a smart phone, a tablet, a server, or a cloud computing platform of connected cloud processors and cloud data storages.

The term "drillability curve" can refer to a curve that indicates favorable conditions in the wellbore that allow the drilling to continue safely, efficiently and effectively at all time.

The term "engineering curve" as used herein can refer to a curve that shows trends in wear of a drilling rig and downhole equipment that indicates favorable conditions of the equipment while drilling a well. Engineering curves indicate performance for downhole tools to ensure success while drilling.

The term "engineering information" as used herein can refer to at least one of: hole depth which can be: hole depth measured to TD, true vertical depth, sample depth (also known as lag); drillability curves; rates of penetration of a drill bit; mud properties such as mud weight, viscosity, pH, chloride content, temperature, water loss; survey data such as azimuth inclination; standpipe pressure; casing pressure; pump stroke rates; torque on drilling equipment; rotary speed of the drilling equipment such as rotation per minute (rpm) of the drill bit; bit rotation of the drill bit; wellbore hole geometry including casing depth information and/or depths of tubular connection; and information on tubulars being run into casing. Similar information can be included as engineering information.

The term "engineering information" can include a calculation on wear on drilling equipment using computer instructions from the well sensor information. The engineering information can include a calculation for at least one of: a potential mechanical failure for drilling equipment, such as failure of a mud pump, or a calculation for a rate of wear on drilling equipment, such as rate of wear on a drilling bit.

The term "geological information" as used herein can refer to at least one of: rock lithology description, trace rock porosity, rock type, percent of fluorescence of rock; type of hydrocarbon cuttings; formation types, formation names, formation tops, rock formation anomalies such as faults, and percent drill cuttings.

The term "geochemical surface well log" as the term is used herein can refer to a presentation of surface well drilling data that is geochemical. Geochemical information can include data and information referring to an entire logging interval from start time to stop time as well as a defined depth, such as a first 400 feet of a well. The geochemical surface well log can contain all data, the index, comments, the headers, the footers, the user information and service provider contact information.

The term "geochemical testing information" as used herein can refer to at least one of: drilling mud gas content aromatic hydrocarbons, alkanes, cycloalkanes, nitrogen, oxygen, argon, water vapor, carbon dioxide, helium hydrogen, hydrogen sulfide, sulfur monoxide, sulfur dioxide, carbon disulfide, and molecular ratios using analyzed species of molecules.

The term "geochemical information" can include at least one of a reservoir analysis, such as detection of oil in shale or, fluid migration identification such as migration of oil through a fractionation field; anomaly reservoir identification such as a concentration of one type of geological features or in kind parameters forming a trend such as a rising fault line towards the surface or a subsurface fold or an anticline or a syncline; a tracking of heavier hydrocarbons than measureable with a gas chromatograph such as tracking of hexane, a source rock identification such as identification of shale, and a fluid movement analysis through rock, such as trend analysis showing an increase in oil in a compass direction after water is pumped into a well.

The term "graphical well sensor track" can refer to a graphical depiction first over time and second over depth of one or more types of well sensor information, such as standpipe pressure or casing pressure. The graphical well sensor track receives and displays a plotted well sensor curve from a sensor in or around a drilling rig, such as a pump pressure, torque, weight on bit, block height, rotary speed, and similar information including annulus pressure, casing pressure and similar measureable values. Information from pit volume totalizer can be included in graphical well sensor tracks.

The term "molecular ratios" as used herein can refer to mathematical formulas that use molecular species from tested geochemical information to form synthetic curves.

The mathematical formulas can for example, create Pixler ratios, wetness ratios, balance ratios, character ratios, and heavy hydrocarbon to light hydrocarbon ratios.

The term "macroview log plot" as used herein can refer to a graphical depiction of an entire portion of the well log. The macroview log plot can be a visual presentation of a compressed view of the entire well log. The macroview log plot can depict the entire drilling project at any point in time. In embodiments, the macroview log plot has an index, scaled values, and lithology comments.

In embodiments, the macroview log plot can further include a shaded box graphically depicting an area of the microview log plot. The macroview log plot can be graphically displayed in color or as a shaded area.

The term "mass spectrometer" can refer to an inline mass spectrometer analyzer that continuously receives fluid samples, such as positive pressure fluid samples from a total hydrocarbon gas analyzer, or positive pressure fluid samples from a gas trap, or fluid samples from the wellbore, and calculates a charge to mass ratio for individual molecular species of the fluid samples.

Usable mass spectrometers for this system measure components of process gasses quantitatively and measure components of process gasses for purity of components found in process gases. An example of a usable mass spectrometer can be a quadrupole mass analyzer.

The term "microview log plot" as used herein can refer to a graphical depiction of a small portion of the well log.

In embodiments, a microview log plot can have an index and scaled values for a defined drilling interval, less than the entire logging interval. The microview log plot can have at least one graphical drilling information track, and lithology comments. In embodiments, the microview log plot can have a header with user information and or service provider contact information.

The term "molecular curves" can refer to computed curves using molecular concentrations from the mass spectrometer. Molecular curves provide continuous digital values of a single molecular species.

The term "near real time" can refer to the time interval between when data is received for analysis and analysis is performed and then displayed on the geochemical surface well log such as within a time interval as short as 3 seconds or up to 3 hours.

The term "network" can refer to a satellite network, a cellular network, a local area network, a wide area network, the internet, another global communication network or multiple networks connected together.

The term "pattern" can refer to a color or a repeated symbol to indicate a rock type, or a percentage of percentage of molecular species based on fluid testing.

The term "synthetic curve" can refer to a curve that is created by applying a mathematical operation to two or more concentrations of analyzed molecular species.

A "synthetic curve" in embodiments can be engineering data that is plotted either over time or over depth. For example a synthetic curve can be plotted against time, depth or both showing a "drillability curve" referred to as a Dexponent or DCexponent. Another type of synthetic curve is termed "equivalent circulating density ECD" for mud properties, which allows a geologist to manage mud properties which is plotted against depth and time.

The term "trend" can refer to an observed direction of data values within a data set. The data values can be collective or individual trend. A trend can show an increasing drill rate and an increasing gas reading which once identified can cause increased safety and increased economic decisions to be made. Trends can identify a worn out drilling bit by identifying a trend in decreasing drill time or a reduced number of feet drilling allowing an operator to decide to trip out a hole.

A "trend" in mapping a geological basin is an identification of an increase in a particular molecular species as drilling occurs, to indicate and increase in oil versus gas.

Trends can be mapped with this invention across multiple wellbores reinforcing certain subsurface mapping technique. Trends in embodiments can be identified in the geochemical well log for a single wellbore.

The term "trends" can include graphically viewable trends in the geochemical surface well log that identify boundaries of one or more geological features on a macro or micro level. The term "trend" can include trends that identify features of geologic interest.

Within the scope of this invention, "trends" can identify movement or migration of identified fluids through rock. Additionally the trends can show patterns in rock to depict the evolution of a reservoir. Trace elements of molecules can indicate how the reservoir evolved and since a reservoir changes when fractionation is performed, trace elements shown in the well log can depict patterns showing the changes in the reservoir as production continues into the future.

The graphical display of trends in the geochemical surface well log allows geologists to create regional or local geological mapping for a geological basin.

Trends visually allow a geologist to see the evolution of a productive geological basin from an economic standpoint. The mapping of the reservoirs allows the geologists and engineers working on the drilling site to make projections in time on the return of investment on the drilling and to reorient drilling if needed due to safety reasons.

The term "user information" can refer to a name of a well, a name of a well operator, a location of a well, a height of a well and an American Petroleum Institute (API) number or a Unique Well Identifier from the Canadian counterpart to the API. The "user information" can include at least one of: a target depth of the well to be drilled, a name of a drilling owner, a name of a well logger, and a ground level of the well.

The term "wellbore" as used herein can refer to a bore of a hydrocarbon well or geothermal well being drilled with a drill bit using a drilling well fluid. The term can also refer to a well that is being fractionated or "worked over."

The term "well sensors" as used herein can refer to sensors that detect concentrations of components in gas or concentrations of components in fluids coming from the wellbore.

The term "well sensor curves" or "sensed curves" can refer to curves depicting an average weight on drill bit plotted against depth, an instant average reading, as well as a rate of penetration for a well bit plotted against depth.

Many of these well sensor curves are plotted against depth. The well sensor curves can also be plotted against time in this system.

A feature of the system is the ability to toggle between well sensor curves over depth and well sensor curves over time. The well sensor curve can be a plot of pump pressure versus time. Bit torque can also be portrayed as a well sensor curve over time or over depth or both.

The term "well sensor information" as used herein can refer to information from sensors that detect gas trapped in drilling mud, gas trapped in drilling cuttings, and sensors that detect fluids in the drilling muds and drill cuttings.

The invention relates to a system for creating a geochemical surface well log in near real time with at least one graphical drilling track for a geothermal, hydrocarbon, or testing well.

The system uses digital sensed data from sensors, analyzed fluid testing data from analyzers and computer instructions to populate a geochemical well log template to form a geological surface well log.

Information used to populate the template include fluid testing data, and at least one of: well sensor data, geochemical testing information, geological information, and engineering information, and communicating the geochemical surface well log to a client device over a network.

Turning now to the Figures, FIG. 1 depicts an embodiment of the system. The system can include a well fluid processor 10 connected to a first network 14. The well fluid processor 10 can communicate with at least one rig sensor 16*a* and 16*b* on a drilling rig 18.

The well fluid processor 10 can communicate with a third party processor 20 through a second network 15 that further communicates with the first network 14. The third party data processor 20 receives sensor information from at least one downhole sensor 24 in the wellbore 26.

The well fluid processor 10 can communicate electronically with a mass spectrometer 28. The mass spectrometer 28 receives fluid samples 50 from the wellbore 26, such as through a total hydrocarbon analyzer 42 or a gas trap 52.

The gas trap 52 in an embodiment includes an agitator, a maintenance free agitator or another device for sampling drilling fluids from a wellbore that fluidly connects to the wellbore 26.

The processors for the mass spectrometer, the third party processor and well fluid processor can be computers, laptops, or servers and similar computer data processing devices that communicate electronically via a network.

The first network 14, in embodiments, is one network, two or more connected networks, such as cellular networks, the Internet, satellite networks, or combinations of these types of networks. The second network can be identical to the first network.

The mass spectrometer communicates with the well fluid processor through the first network to send fluid testing data to the well fluid data storage.

The well fluid processor 10 can further communicate with one or more client devices 34*a* and 34*b* which can each be in electronic communication with the network 14.

Each client device 34*a* and 34*b* can contain a client device processor in communication with a client device data storage connected to a client device display. Client device 34*a* can be a cell phone. Client device 34*b* can be a computer.

The client device 34*a* can have a client device display 40*a* showing first alarm 62 as a giant star and a second alarm 64 as the giant word "STOP". Client device 34*b* can have a client device display 40*b* showing a geochemical surface well log 400.

All the client devices can be computers in an embodiment. All the client devices can be tablet computers, smart phones, or similar portable communicating and processing devices in another embodiment.

The alarms are generated by computer instructions in the well data storage 12.

In embodiments, the well fluid processor 10 can communicate with a total hydrocarbon analyzer 42, a flow meter 44, and a gas chromatograph 46. The well fluid processor can receive the analyzed information from these instruments for presenting the analyzed fluid testing information into a geochemical surface well log that is formed using computer instructions in the well fluid data storage.

The mass spectrometer 28, total hydrocarbon analyzer 42, flow meter 44 and gas chromatograph 46 can be connected to a sample conduit 48 containing fluid samples 50, such as gas samples from the wellbore 26.

A gas trap 52 can capture the fluid samples from the wellbore 26 for conveying to the various analyzers and the flow meter.

Also shown are a carbon dioxide sensor 66 and a hydrogen sulfide sensor 68. These two sensors can be inserted into the sample conduit and can be further in communication with the first network 14 to provide additional well fluid testing information to the well fluid processor 10.

In embodiments, the well fluid processor can communicate with a remote processor with a remote data storage containing engineering information on equipment in the wellbore; and using computer instructions in the well fluid data storage to obtain information from the at least one: sensor and processor for populating the geochemical well log template forming the geochemical surface well log.

Figure 2:
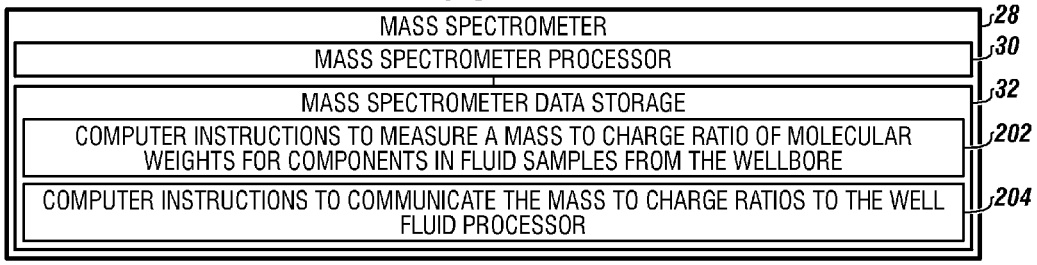
FIG. 2 depicts the mass spectrometer with mass spectrometer data storage.

FIG. 2 shows the mass spectrometer 28 having a mass spectrometer processor 30 connected to a mass spectrometer data storage 32 and a plurality of computer instructions in the mass spectrometer data storage. The mass spectrometer processor 30 can be a computer.

The mass spectrometer processor 30 communicates with a mass spectrometer data storage 32, which can be memory of a computer connected to a processor.

The mass spectrometer receives fluid samples in this embodiment from the total hydrocarbon analyzer.

The mass spectrometer data storage can include computer instructions 202 to measure a mass to charge ratio of molecular weights for components in fluid samples from the wellbore.

The mass spectrometer data storage includes computer instructions 204 to communicate the calculated mass to charge ratios to the well fluid processor 10.

Figure 3A:
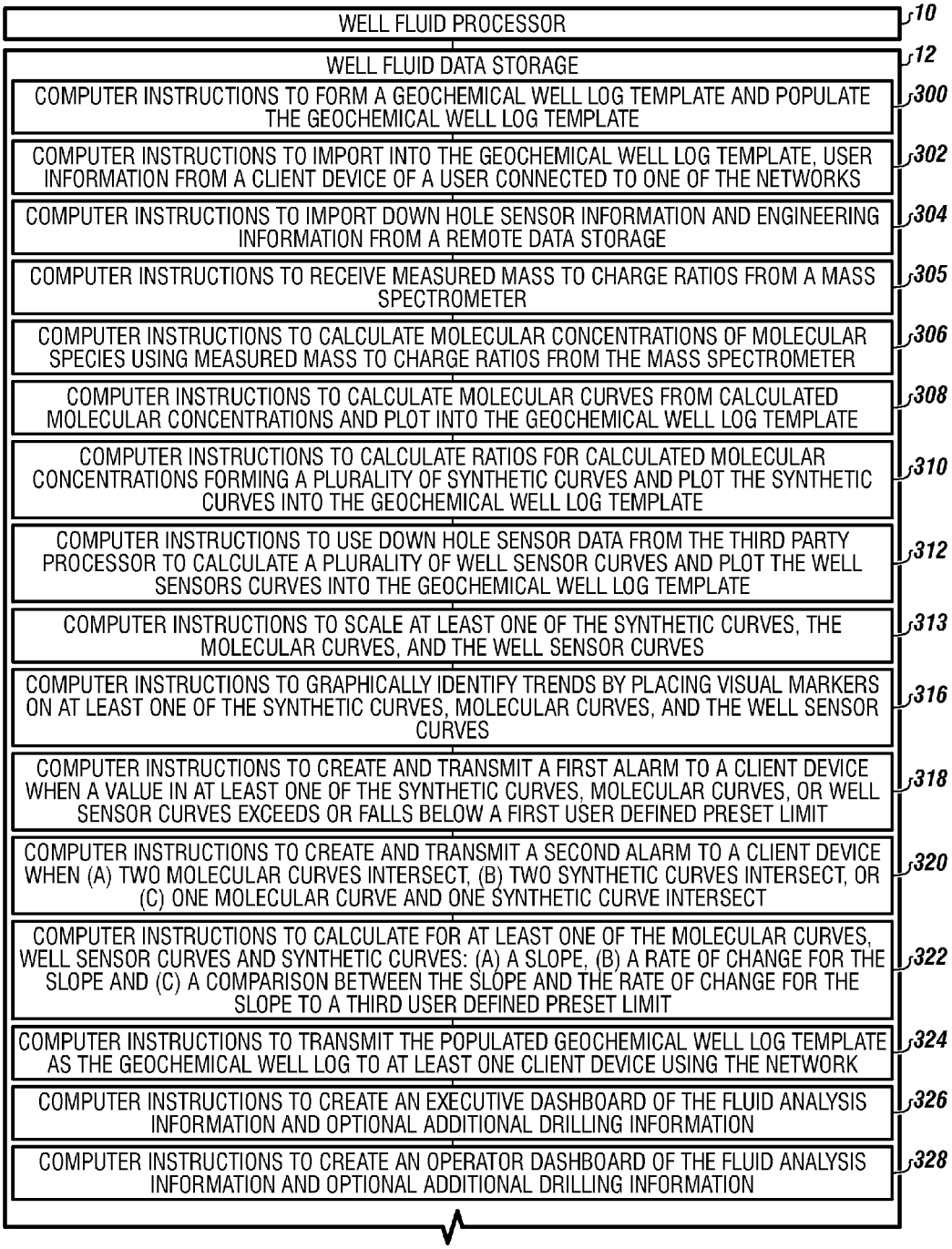
FIGS. 3A-3C depict the well fluid data storage containing computer instructions which are implemented by the well fluid processor.
Figure 3B:
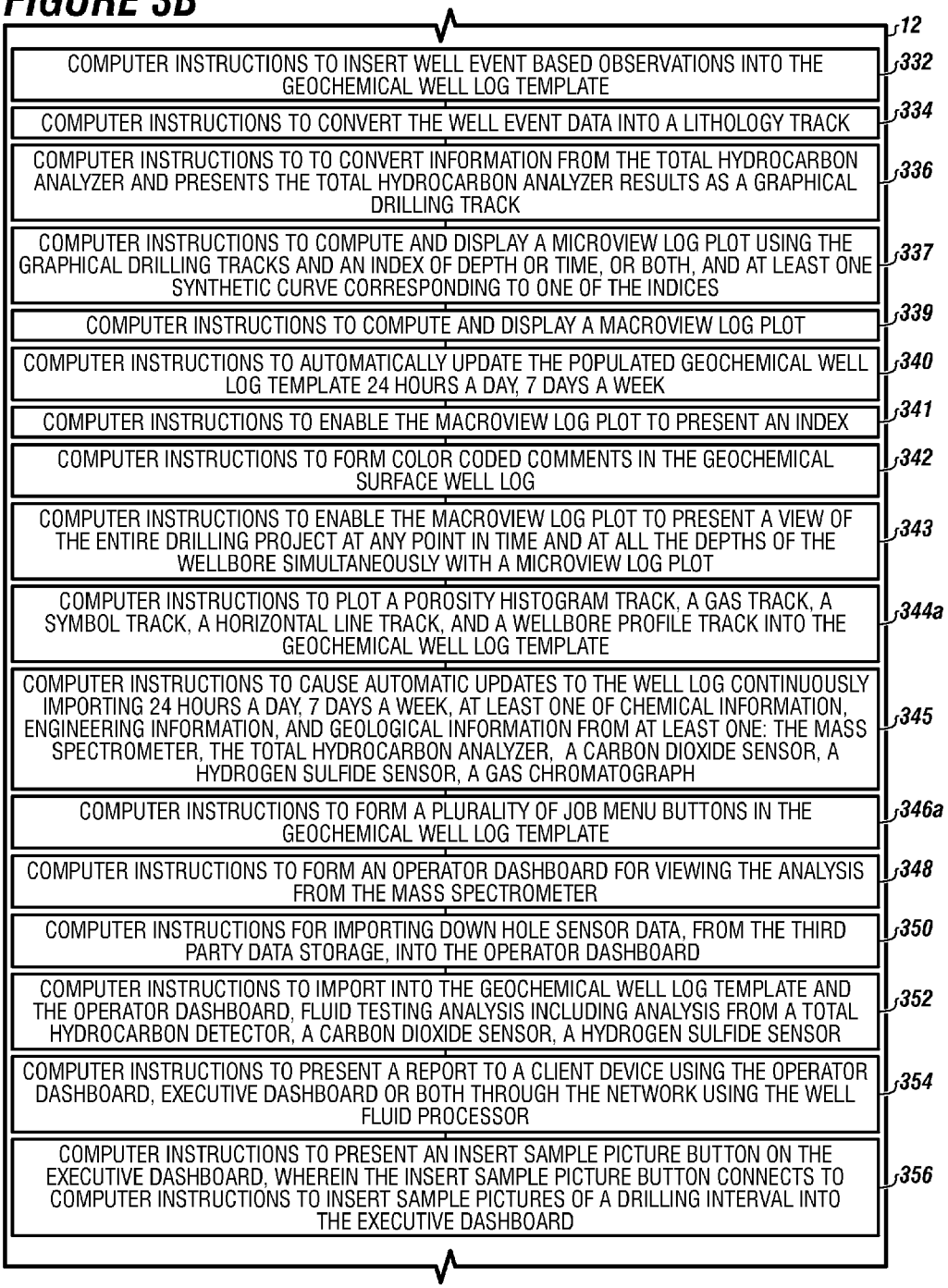
Figure 3C:
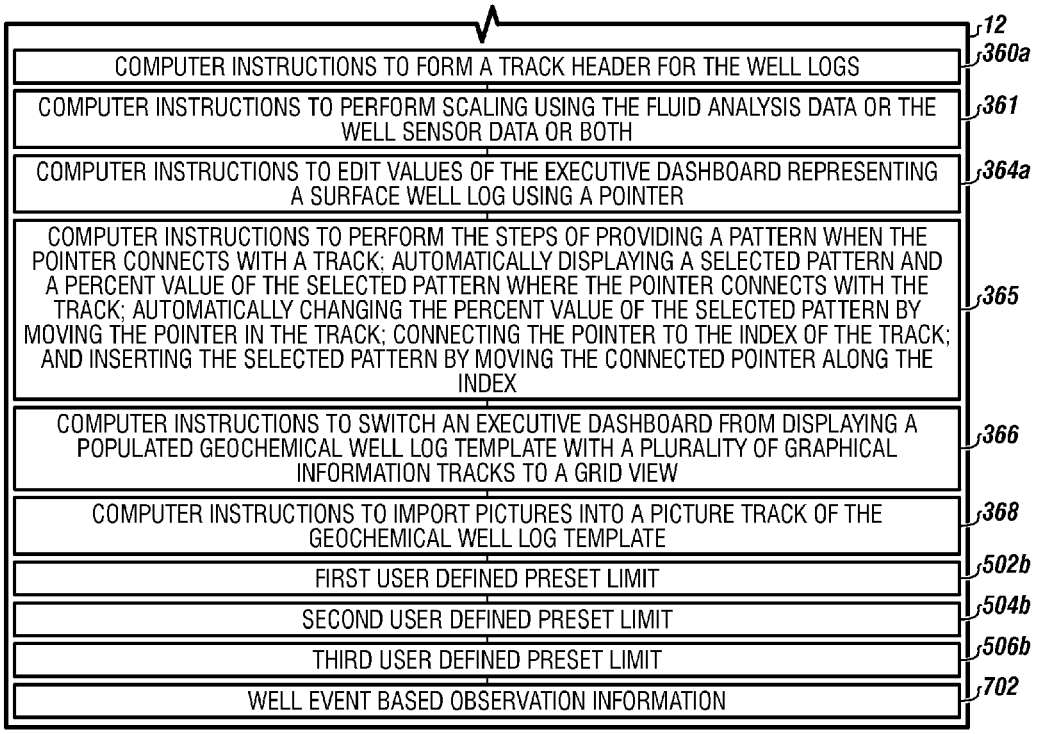

FIGS. 3A-3C depicts a well fluid processor 10 in communication with well fluid data storage 12 containing computer instructions and other data according to an embodiment of the invention.

The well fluid data storage can include computer instructions 300 to form a geochemical well log template and populate the geochemical well log template.

The computer instructions 300 to form and populate the geochemical well log template with user information, well information, and at least one of: engineering information from a third party processor connected to downhole sensors, engineering information from rig sensors, additional fluid analysis information from a total hydrocarbon analyzer, measured values from a carbon dioxide sensor, and measured values from a hydrogen sulfide sensor.

The well fluid data storage can include computer instructions 302 to import into the geochemical well log template, user information from a client device of a user connected to one of the networks.

The well fluid data storage can include computer instructions 304 to import downhole sensor information and engineering information into the geochemical well log template from a remote data storage.

The well fluid data storage can include computer instructions 305 to receive measured mass to charge ratios from a mass spectrometer.

The well fluid data storage can include computer instructions 306 to calculate molecular concentrations of molecular species using measured mass to charge ratios from the mass spectrometer.

The well fluid data storage can include computer instructions 308 to calculate molecular curves from calculated molecular concentrations and plot into the geochemical well log template.

The well fluid data storage can include computer instructions 310 to calculate ratios for calculated molecular concentrations forming a plurality of synthetic curves and plot the synthetic curves into the geochemical well log template.

The well fluid data storage can include computer instructions 312 to use downhole sensor data from the third party processor to calculate a plurality of well sensor curves and plot the well sensors curves into the geochemical well log template.

The well fluid data storage can include computer instructions 313 to scale at least one of the synthetic curves, the molecular curves, and the well sensor curves.

The well fluid data storage can include computer instructions 316 to graphically identify trends by placing visual markers on at least one of the synthetic curves, molecular curves, and the well sensor curves.

The well fluid data storage can include computer instructions 318 to create and transmit a first alarm to a client device when a value in at least one of the synthetic curves, molecular curves, or well sensor curves exceeds or falls below a first user defined preset limit.

The well fluid data storage can include a first user defined preset limit 502*b* for use with the first alarm. For example, the first user defined preset limit 502*b* could be a pump pressure falling below 200 psi which would indicate a loss of pump pressure.

The well fluid data storage can include computer instructions 320 to create and transmit a second alarm to a client device when (a) two molecular curves intersect, (b) two synthetic curves intersect, or (c) one molecular curve and one synthetic curve intersect.

The well fluid data storage can include a second user defined preset limit 504*b* for use with the second alarm when the synthetic curves, molecular curves or one synthetic curve and one molecular curve intersect. For example, the second user defined preset limit can be a limit for a hydrocarbon to air ratio such as 5:1.

The well fluid data storage can include computer instructions 322 to calculate for at least one of the plurality of molecular curves, well sensor curves and synthetic curves, at least one of the following: a slope; a rate of change for the slope; and a difference between the slope or the rate of change for the slope to a second user defined preset limit. The second user defined preset limit can be in at least one of: the client device data storage and the well fluid data storage and using the difference to determine if an anomaly is present for either: a drilling process, a rock formation, or for a drilling process and a rock formation.

The well fluid data storage can include a third user defined preset limit 506*b*. For example, a slope preset limit of less than 2 minutes per foot squared a rate of penetration curve for a well sensor curve.

The well fluid data storage can include computer instructions 324 to transmit the populated geochemical well log template as the geochemical well log to at least one client device using the network.

The well fluid data storage can include computer instructions 326 to create an executive dashboard of the fluid analysis information and optional additional drilling information.

The well fluid data storage can include computer instructions 328 to create an operator dashboard of the fluid analysis information and optional additional drilling information.

The well fluid data storage can include computer instructions 332 to insert well event based observations into the geochemical well log template.

The well fluid data storage can include computer instructions 334 to convert the well event data into a lithology track.

The well fluid data storage can include computer instructions 336 to convert information from the total hydrocarbon analyzer and presents the total hydrocarbon analyzer results as a graphical drilling track.

The well fluid data storage can include computer instructions 337 to compute and display a microview log plot using the graphical drilling tracks and an index of depth or time, or both, and at least one synthetic curve corresponding to one of the indices.

The well fluid data storage can include computer instructions 339 to compute and display a macroview log plot. The macroview log plot can contain at least one of scaled well sensor information, well sensor curves, synthetic curves, molecular curves, slope of a molecular curve, or a rate of change of slope of the molecular curve, slope of the synthetic curve, or a rate of change in slope of the synthetic curve; a graphic analysis curve; or combinations thereof, wherein the macroview log plot is a view of the entire drilling project at any point in time and at all the depths of the wellbore.

The well fluid data storage can include computer instructions 340 to automatically update the populated geochemical well log template 24 hours a day, 7 days a week.

The well fluid data storage can include computer instructions 341 to enable the macroview log plot to present an index.

The well fluid data storage can include computer instructions 342 to form color coded comments in the geochemical surface well log.

The well fluid data storage can include computer instructions 343 to enable the macroview log plot to present a view of the entire drilling project at any point in time and at all the depths of the wellbore simultaneously with a microview log plot.

The simultaneous display of the microview and macroview log plots enable safety interpretations for drilling, geological interpretations for drilling, operational interpretations for drilling, and combinations of these interpretations, in near real time in less than 3 hours from obtaining the sensed data for viewing by multiple client devices connected to the network simultaneously.

The well fluid data storage can include computer instructions 344*a* to plot a porosity histogram track, a gas track, a symbol track, a horizontal line track, and a wellbore profile track into the geochemical well log template. Identical computer instructions can be found in the client device data storage.

The well fluid data storage can include computer instructions 345 to cause automatic updates to the well log continuously importing 24 hours a day, 7 days a week, at least one of chemical information, engineering information, and geological information from at least one: the mass spectrometer, the total hydrocarbon analyzer, a carbon dioxide sensor, a hydrogen sulfide sensor, a gas chromatograph.

It should be noted that the colors can be selected to separately indicate: a trend identification; at least one drill pipe connection; a survey comments to authenticate actual survey information or reference actual survey information; a drilling parameter; other well fluid related information; a gas peak indicated as a text value on the top of each total gas peak; one or more pieces of faulty equipment; a dated depth; a gas show; and combinations thereof.

The well fluid data storage can include computer instructions 346*a* to form a plurality of job menu buttons in the geochemical well log template. Identical computer instructions can be in the client device data storage.

The job menu buttons can connect to computer instructions that enable the user in the well log to create a new job; open an existing job; restore a job from backup; close an open job; import well fluid testing data, import well sensor information, or combinations thereof; export data from the executive dashboard including a portion of the well log in a graphical format, export data from the executive dashboard including a portion of the well log in a digital format, or export data from the executive dashboard in both formats simultaneously; print a well log; edit preferences; and exit.

The well fluid data storage can include computer instructions 348 to form an operator dashboard for viewing the analysis from the mass spectrometer.

The well fluid data storage can include computer instructions 350 for importing downhole sensor data from the third party data storage into the operator dashboard.

The well fluid data storage can include computer instructions 352 import into the geochemical well log template and the operator dashboard, fluid testing analysis including analysis from a total hydrocarbon detector, a carbon dioxide sensor, a hydrogen sulfide sensor.

The well fluid data storage can include computer instructions 354 to present a report to a client device using the operator dashboard, executive dashboard, or both through the network using the well fluid processor.

The well fluid data storage can include computer instructions 354 to present a report to a client device using the operator dashboard, executive dashboard, or both through the network using the well fluid processor.

The report choices can be create new report; view/edit report; replace a picture to insert a slice of a well log into a report; delete a report from a list of reports; make PDF button; and combinations thereof.

The well fluid data storage can include computer instructions 356 to present an insert sample picture button on the executive dashboard, wherein the insert sample picture button connects to computer instructions to insert sample pictures of a drilling interval into the executive dashboard.

The well fluid data storage can include computer instructions 360*a* to form a track header for the well logs. Identical computer instructions can be in the client device data storage.

The track header can include at least one of: benzene concentration; toluene concentration; ethyl benzene concentration; xylenes concentration; naphthalenes concentration; naphthenes and cylcloalkane concentration; acetic acid concentration; nitrogen, oxygen, argon, and water vapor concentration; carbon dioxide, helium and hydrogen concentration; sulfur species concentration; methane concentration (C1); ethane concentration (C2); propane concentration (C3); butane concentration (C4); pentane concentration. (C5); hexane concentration (C6); heptane concentration (C7); octane concentration; (C8); nonane concentrate (C9); and decane concentration (C10).

The track header can include Pixler ratios; wetness balance character ratios, and air to hydrocarbon ratios.

The well fluid data storage can include computer instructions in the well fluid data storage and client device data storage can create a track header having at least one of: a Pixler ratio; a wetness ratio; a balance ratio, a character ratio, and an air to hydrocarbon ratio.

The well fluid data storage can include computer instructions 361 to perform scaling using the fluid analysis data or the well sensor data or both.

The scaling is performed (a) to identify a scale with a minimum and a maximum value; (b) to identify a type of value to be plotted on the scale; (c) to subtract the minimum value from the value to be plotted forming a result; and (d) to divide the result by the maximum value of the identified scale versus the minimum value of the identified scale forming a scaled value.

The well fluid data storage can include computer instructions 364*a* to edit values of the executive dashboard representing a surface well log using a pointer. Identical computer instructions can be in the client device data storage.

The well fluid data storage can include computer instructions 365 to perform the steps of providing a pattern when the pointer connects with a track; automatically displaying a selected pattern and a percent value of the selected pattern where the pointer connects with the track; automatically changing the percent value of the selected pattern by moving the pointer in the track; connecting the pointer to the index of the track; and inserting the selected pattern by moving the connected pointer along the index.

The well fluid data storage can include computer instructions 366 to switch an executive dashboard from displaying a populated geochemical well log template with a plurality of graphical information tracks to a grid view.

The well fluid data storage can include computer instructions 368 to import pictures into a picture track of the geochemical well log template.

The pictures are imported from at least one of the following: a well fluid cam; a camera mounted on a wireline; a camera viewing drilling cuttings; a camera viewing results of chemical tests; and a camera viewing a specimen from a wellbore.

The well fluid data storage can include well event based observation information 702

Figure 4A:
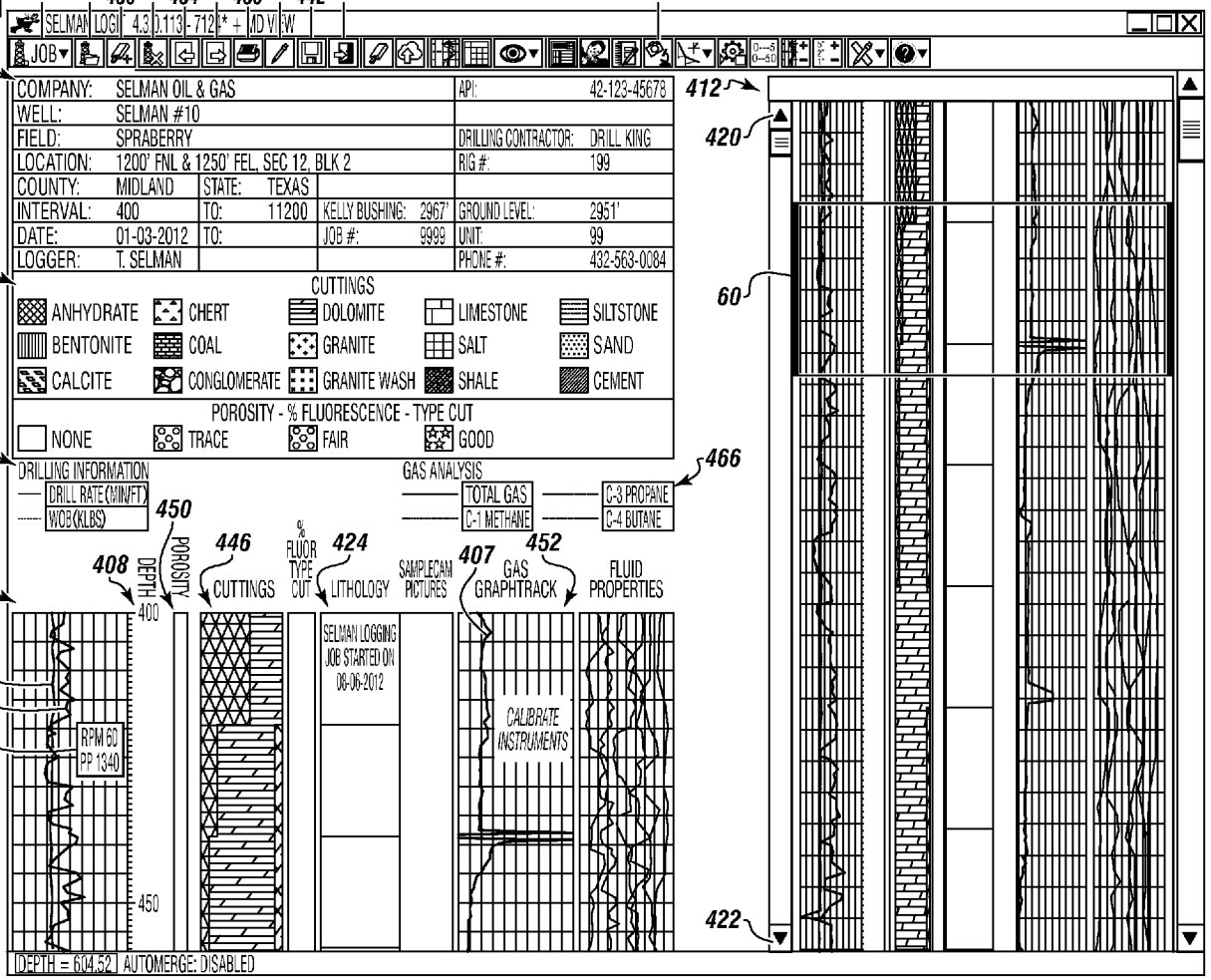
FIG. 4A depicts an executive dashboard according to one or more embodiments.

FIG. 4A shows a first executive dashboard.

The executive dashboard 400 presents user information 402 and well sensor information 404, engineering information 406, and fluid testing information 407 in either a vertical or horizontal orientation using a measured depth index 408, a microview log plot 410 and a macroview log plot 412.

The user can scroll data tracks using a scroll down button 420, and a scroll up button 422.

A trend can be identified in the well log using a visual marker 60 across at least one of: the synthetic curve, the molecular curves, and the well sensor curves.

The geochemical surface well log can have a macroview plot log and microview plot log displayed simultaneously on the geochemical surface well log in this embodiment.

The well log contains well event based observational data comprising lithology analysis 424 and drill cuttings analysis 446.

Comments 448 such as a pump pressure of 1340, a weight on bit of 150 kilopounds, and an rpm of 60, are shown in the executive dashboard.

The executive dashboard can continuously import 24 hours a day, 7 days a week, simultaneously at least one of molecular curves, synthetic curves, well sensor curves, engineering data, and geological information including lithology observational comments.

In embodiments, the comments can be color coded, wherein the colors are selected to separately indicate at least one of: a trend identification; at least one drill pipe connection; survey comments to authenticate actual survey information or reference actual survey information; a drilling parameter; a gas peak indicated as a text value on the top of each total gas peak; at least one piece of faulty equipment; a dated depth; and a gas show.

The executive dashboard can include a porosity histogram track 450; a gas graph track 452; a symbol track (not shown); a horizontal line track; and a wellbore profile track (not shown).

The executive dashboard can include in embodiments, a plurality of job buttons on the geochemical surface well log comprising at least one of: create a new job 426; open an existing job 428; restore a job from backup 430; close an open job 432; import data 434 from at least one of: well fluid testing data, and well sensor information; export data 436; print the geochemical surface well log 438; edit the geochemical surface well log 440; save 442; and exit 444.

The executive dashboard includes, in embodiments, a sample picture 460.

The geochemical surface well log in embodiments includes a track header 462 which can be for all of the curves or single molecular curves. The track header can have at least one of: benzene concentration; toluene concentration; ethyl benzene concentration; xylenes concentration; naphthalenes concentration; naphthenes and cylcloalkane concentration; acetic acid concentration; nitrogen, oxygen, argon, and water vapor concentration; carbon dioxide, helium and hydrogen concentration; sulfur species concentration; methane concentration (C1); ethane concentration (C2); propane concentration (C3); butane concentration (C4); pentane concentration. (C5); hexane concentration (C6); heptane concentration (C7); octane concentration; (C8); nonane concentrate (C9); and decane concentration (C10).

The header section can include information that identifies the owner of the associated well, where the associated well is located, the phone number, a date the well log was created can be included, a depth interval range can be depicted as well with starting and ending depths.

The executive dashboard can include patterns 464 such as repeated circles, or cross hatching in the graphical drilling tracks to depict a percent rock in each track.

The executive dashboard can also include a legend 466 in the track header.

Figure 4B:
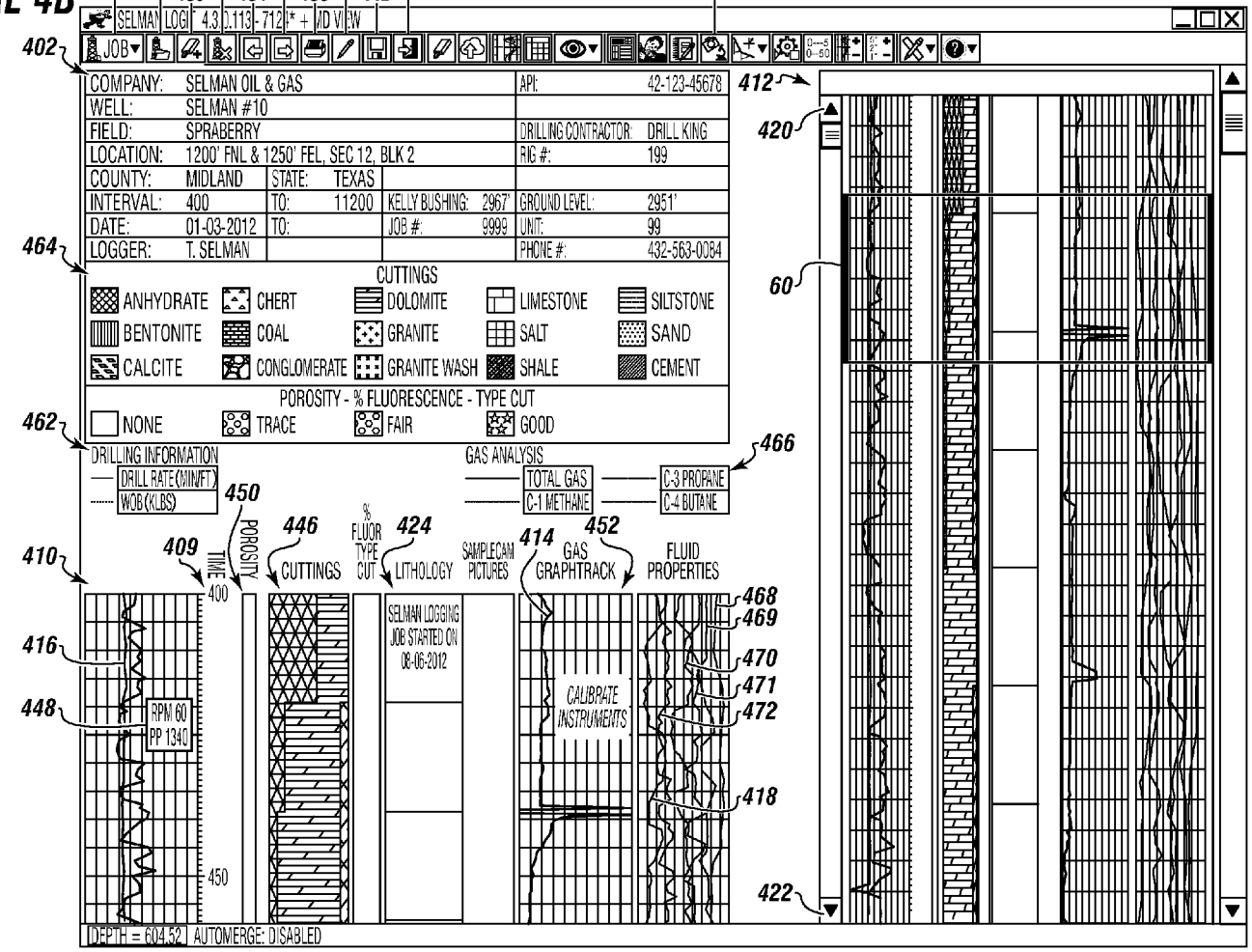
FIG. 4B shows a second executive dashboard with a measured time index according to one or more embodiments.

FIG. 4B shows a second executive dashboard 400 containing most of the features of the first executive dashboard. The second executive dashboard is shown with a measured time index 409 instead of the measured depth index 408.

The microview log plot 410 can have at least one of: a molecular curve 414, a well sensor curve 416, and a synthetic curve 418.

The macroview log plot 412 can have at least one of: a molecular curve 414, a well sensor curve 416, and a synthetic curve 418; and a compressed a view of the entire drilling project at any point in time and at all the depths of the wellbore.

The second executive dashboard features for the synthetic curves, a Pixler ratio 468; a wetness ratio 469, balance ratio 470, character ratio 471, and an air to hydrocarbon ratio 472.

The geochemical surface well log can be editable by a pointer and providing a pattern when the pointer connects with a track; automatically displays a selected pattern and a percent value of the selected pattern where the pointer connects with the track; automatically changing the percent value of the selected pattern by moving the pointer in the track; connecting the pointer to the index of the track; and inserting the selected pattern by moving the connected pointer along the index.

The geochemical surface well log can be shown as a plurality of graphical information tracks to a grid view.

Figure 5:
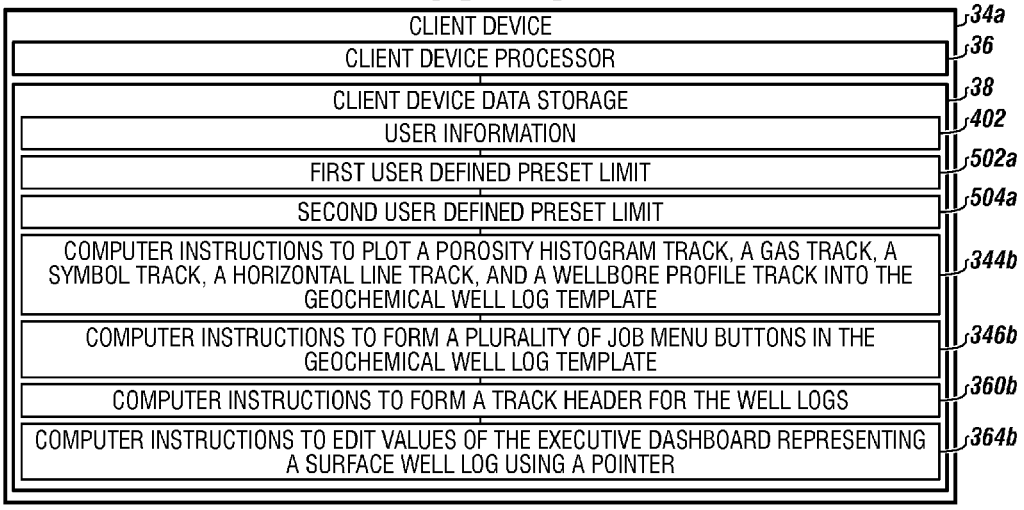
FIG. 5 depicts a client device containing a client device data storage in communication with a client device processor.

FIG. 5 shows a client device 34*a* with a client device processor 36 connected to a client device data storage 38. The client device data storage can include user information 402, a first user defined preset limit 502*a*, a second user defined preset limit 504*a*, and computer instructions 344*b* to plot a porosity histogram track, a gas track, a symbol track, a horizontal line track, and a wellbore profile track into the geochemical well log template.

The client device data storage can include computer instructions 346*b* to form a plurality of job menu buttons in the geochemical well log template. Each button connects to computer instructions that provide different job functionalities, as listed earlier.

The client device data storage can include computer instructions 360*b* to form a track header for the well logs.

The client device data storage can include computer instructions 364*b* to edit values of the executive dashboard representing a surface well log using a pointer.

Figure 6:
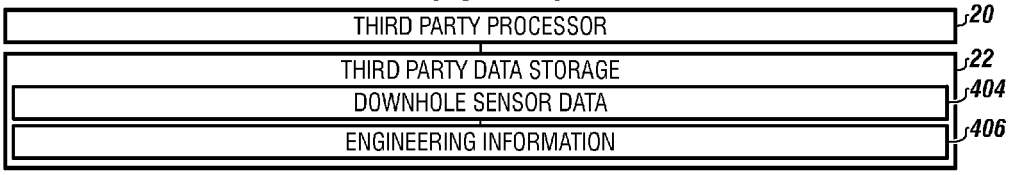
FIG. 6 depicts a third party data storage in communication with a third party processor.

FIG. 6 depicts a third party processor 20 connected to a third party data storage 22 containing downhole sensor data 404 and engineering information 406 which can be measurement while drilling data, such as information from a gamma ray measurement from a downhole assembly.

Figure 7:
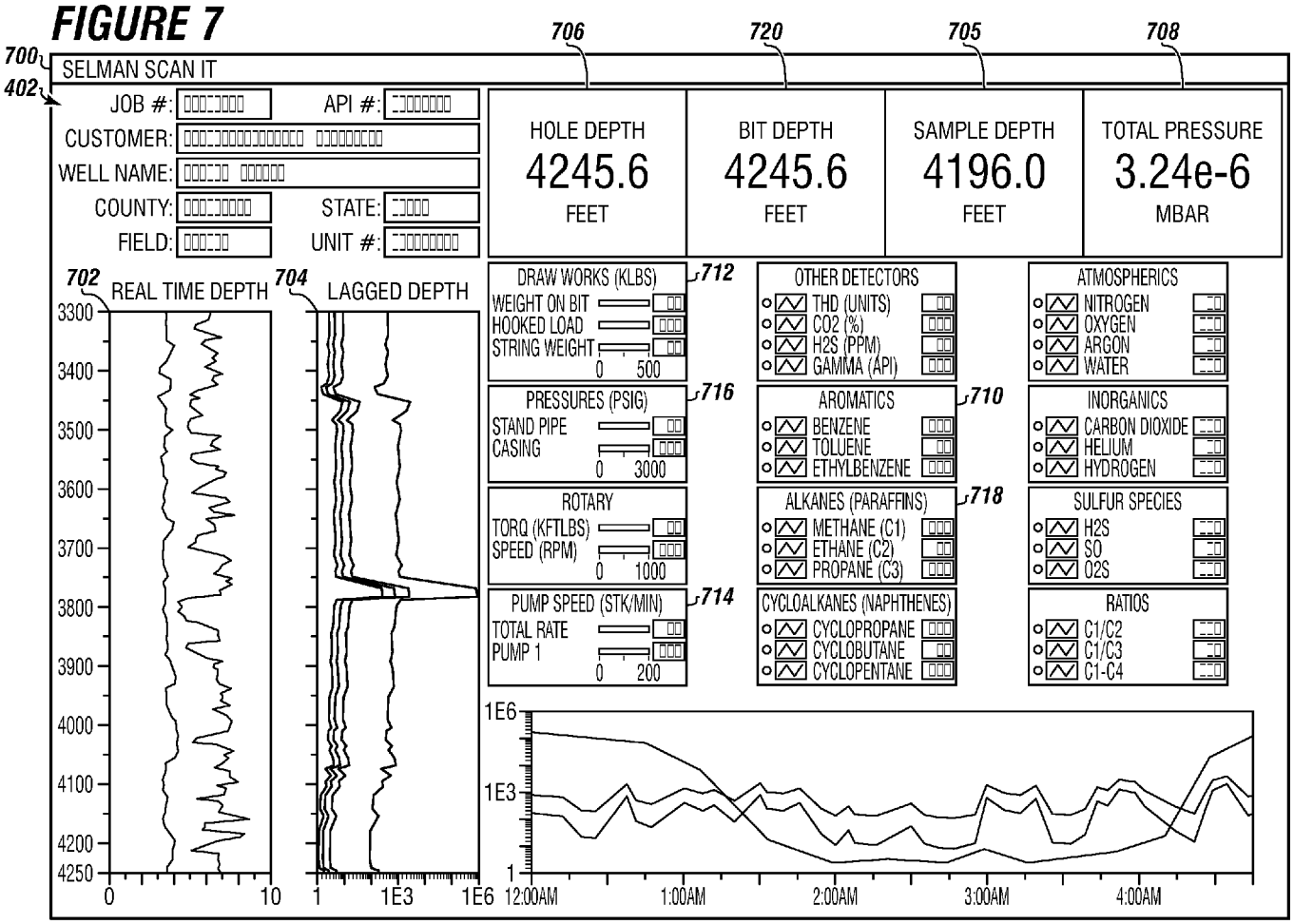
FIG. 7 depicts an operator dashboard.

FIG. 7 shows an operator dashboard usable with the system.

An operator dashboard 700 enables an operator to view analysis from (i) the mass spectrometer analyzer, and (ii) at least one rig sensor to present: a real time depth graphical display 702; a lag depth graphical display 704; a lag depth digital display 705; a hole depth 706; a mass spectrometer reaction chamber pressure 708; a current value of an analyzed component of a fluid sample 710, shown in this Figure as benzene at 153 ppm. Also shown is well sensor information 712 such as a weight on bit sensor showing a reading of 100 kilopounds.

Pump speed 714 and pump pressure 716 can be shown on the operator dashboard.

The molecular curves, the synthetic curves and the well sensor curves can be graphically presented on the operator dashboard and toluene is shown as element 718.

User information 402 is shown. Additional geological information, such as bit depth 720 is depicted. All of the information can be simultaneously shown on the executive dashboard.

Figure 8:
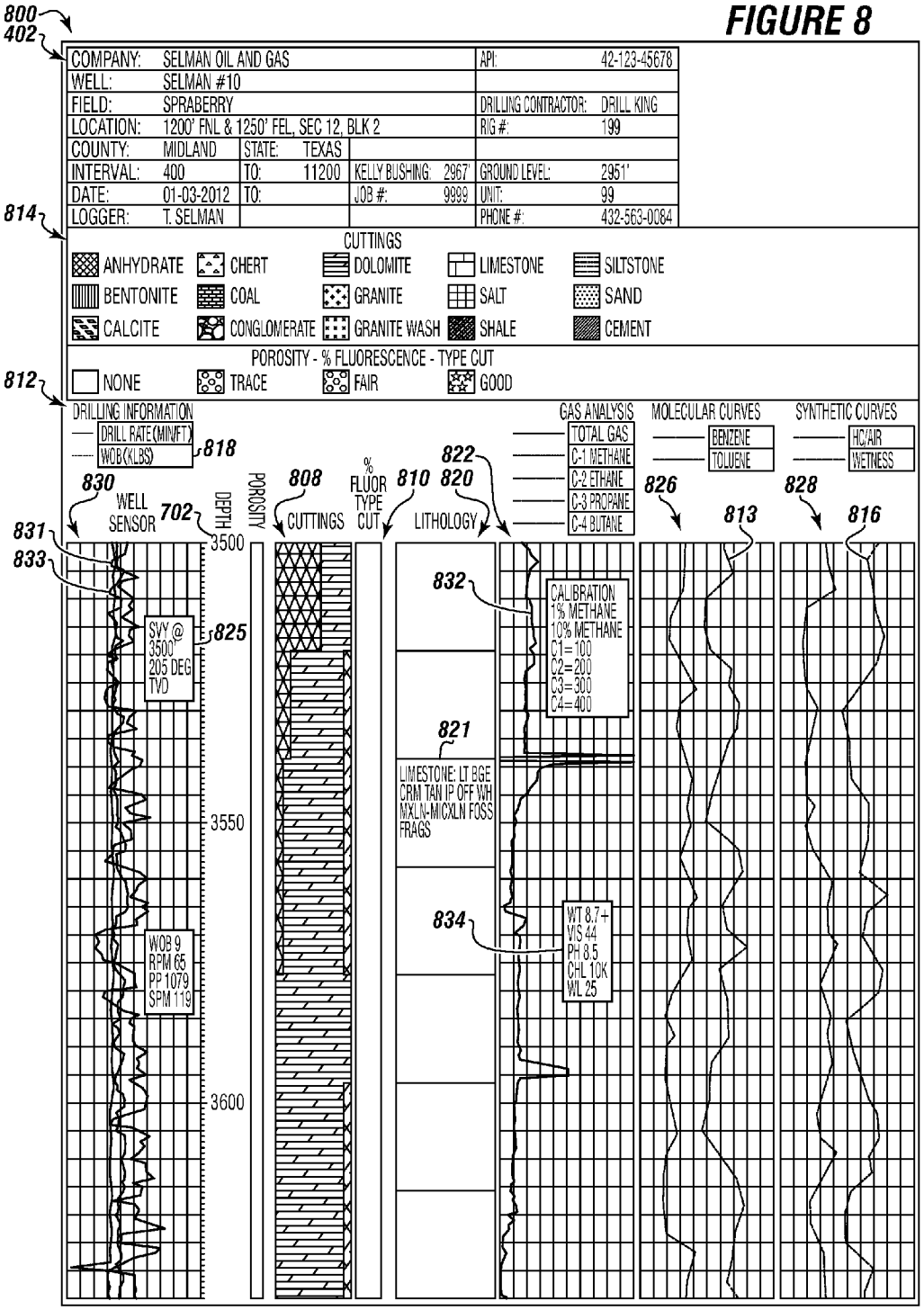
FIG. 8 depicts a geochemical surface well log.

FIG. 8 shows a populated geochemical well log 800 with graphical curves formed using the system.

User information 402 is depicted. The user information includes name of operator, name of well, legal location of the well, a unique well identifier such as an American petroleum institute number, a Kelly Bushing elevation, a ground elevation, a depth interval over which the well is drilled, a date range over which drilling occurs, a unit number, a contact phone number, a drilling contractor name, a rig number, a name of a logger, a job number.

The well log can include a legend 814 showing patterns that can be used for a percent cutting track 808 and patterns for a histogram track 810.

The well log can include a track header 812 with descriptions for all of the graphical drilling tracks, and molecular curves 813 shown as benzene, synthetic curves 816 shown here as an hydrocarbon to air ratio and well sensor curves 818 shown here as a weight on bit.

A lithology description track 820 containing a plurality of lithology comments 821 such as limestone color with geological abbreviations and a fluid testing track 822.

Color coded well event observation comments 825, such as survey at 3500 feet, 205 degrees at a true vertical depth of 698 feet.

A molecular curves graphic track 826 showing a molecular curve of benzene.

A synthetic curves graphic track 828 shows a wetness ratio of 1.2 in this Figure.

A drilling rate curve track 831 is shown in the well sensor graphic track 830 which is shown as a rate of penetration of a drill bit.

A weight on bit curve 833 is shown in the well sensor graphic track 830.

A total gas curve 832 is shown in a fluid testing track 822.

A comment 834 describing fluid testing can be in the fluid testing track 822, such as weight 8.7 pounds per gallon, viscosity of 44 measured ml/seconds, a pH of 8.5.

In one or more embodiments, geosteering software can be usable with the system, which is known in the industry.

Figure 9A:
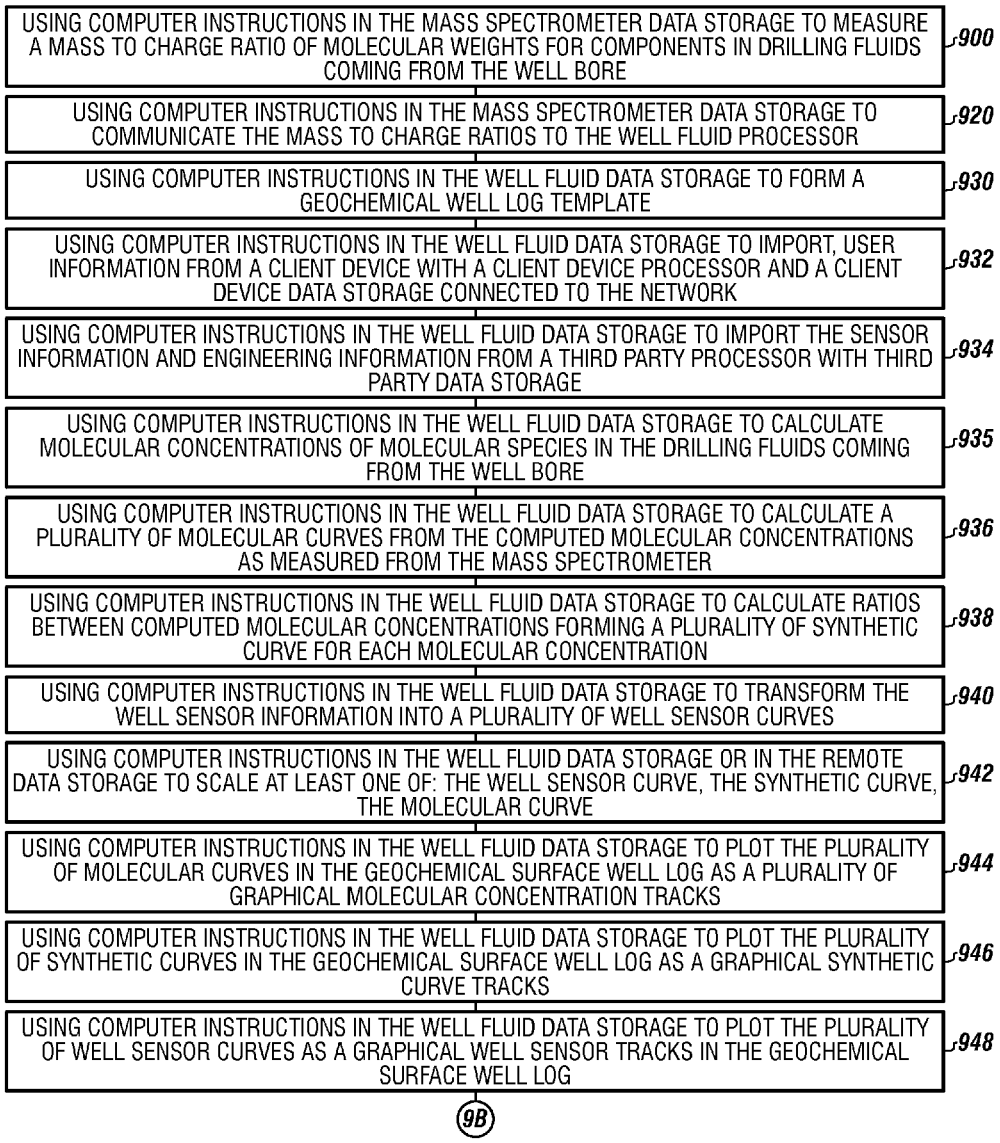
FIGS. 9A-9B depict the sequence steps usable with the system.
Figure 9B:
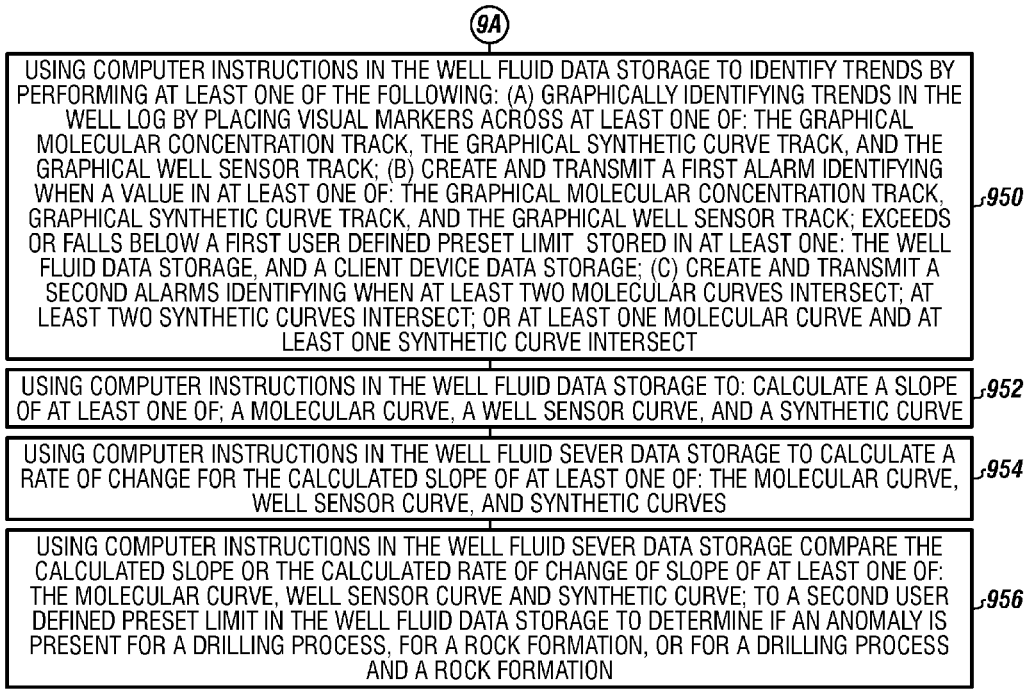

FIG. 9 depicts a sequence of steps usable with the system.

The steps can include using computer instructions in the mass spectrometer data storage to measure a mass to charge ratio of molecular weights for components in drilling fluids coming from the wellbore, as shown in step 900.

The steps can include using computer instructions in the mass spectrometer data storage to communicate the mass to charge ratios to the well fluid processor, as shown in step 920.

The steps can include using computer instructions in the well fluid data storage to form a geochemical well log template, as shown in step 930.

The steps can include using computer instructions in the well fluid data storage to import user information from a client device with a client device processor and a client device data storage connected to the network, as shown in step 932.

The steps can include using computer instructions in the well fluid data storage to import the sensor information and engineering information from a third party processor with third party data storage, as shown in step 934.

The steps can include using computer instructions in the well fluid data storage to calculate molecular concentrations of molecular species in the drilling fluids coming from the wellbore, as shown in step 935.

The steps can include using computer instructions in the well fluid data storage to calculate a plurality of molecular curves from the computed molecular concentrations as measured from the mass spectrometer, as shown in step 936.

The steps can include using computer instructions in the well fluid data storage to calculate ratios between computed molecular concentrations forming a plurality of synthetic curve for each molecular concentration, as shown in step 938.

The steps can include using computer instructions in the well fluid data storage to transform the well sensor information into a plurality of well sensor curves, as shown in step 940.

The steps can include using computer instructions in the well fluid data storage or in the remote data storage to scale at least one of: the well sensor curve, the synthetic curve, the molecular curve, as shown in step 942.

The steps can include using computer instructions in the well fluid data storage to plot the plurality of molecular curves in the geochemical surface well log as a plurality of graphical molecular concentration tracks, as shown in step 944.

The steps can include using computer instructions in the well fluid data storage to plot the plurality of synthetic curves in the geochemical surface well log as a graphical synthetic curve tracks, as shown in step 946.

The steps can include using computer instructions in the well fluid data storage to plot the plurality of well sensor curves as a graphical well sensor tracks in the geochemical surface well log, as shown in step 948.

The steps can include using computer instructions in the well fluid data storage to identify trends by performing at least one of the following: (a) graphically identifying trends in the well log by placing visual markers across at least one of: the graphical molecular concentration track, the graphical synthetic curve track, and the graphical well sensor track; (b) create and transmit a first alarm identifying when a value in at least one of: the graphical molecular concentration track, graphical synthetic curve track, and the graphical well sensor track; exceeds or falls below a first user defined preset limit stored in at least one: the well fluid data storage, and a client device data storage; (c) create and transmit a second alarms identifying when at least two molecular curves intersect; at least two synthetic curves intersect; or at least one molecular curve and at least one synthetic curve intersect, as shown in step 950.

The steps can include using computer instructions in the well fluid data storage to: calculate a slope of at least one of; a molecular curve, a well sensor curve, and a synthetic curve, as shown in step 952.

The steps can include using computer instructions in the well fluid sever data storage to calculate a rate of change for the calculated slope of at least one of: the molecular curve, well sensor curve, and synthetic curves, as shown in step 954.

The steps can include using computer instructions in the well fluid sever data storage compare the calculated slope or the calculated rate of change of slope of at least one of: the molecular curve, well sensor curve and synthetic curve; to a second user defined preset limit in the well fluid data storage to determine if an anomaly is present for a drilling process, for a rock formation, or for a drilling process and a rock formation, as shown in step 956.

The performance of these steps allows the computer instructions to graphically provide in near real time, a geochemical surface well log to a client device for a drilling process of a well to enable safety interpretations for at least one of drilling and economic analysis; geochemical interpretations for at least one of: mapping regionally, mapping locally, timeline modeling of a geological reservoir, economic analysis, and operations; geological interpretations for at least one of: drilling, mapping, modeling, operations, and economic analysis; and engineering interpretations for at least one of: drilling, operations, and economic analysis; in near real time streaming the geochemical surface well log to at least one client device connected to the network.

While these embodiments have been described with emphasis on the embodiments, it should be understood that within the scope of the appended claims, the embodiments might be practiced other than as specifically described herein.

What is claimed is:

1. A system for creating a geochemical surface well log for a wellbore in near real time for a geothermal well, a hydrocarbon well, or testing well, using a well fluid processor to collect analyzed data from fluid analyzers, form the geochemical surface well log, and communicate the formed geochemical surface well log to at least one client device using a network, the system comprising:

a. a well fluid processor and well fluid data storage electronically connected to a network:

b. a mass spectrometer electronically connected to the network and fluidly connected to receive fluid samples from at least one total hydrocarbon analyzer and a wellbore, the mass spectrometer comprising:

i. a mass spectrometer processor;

ii. a mass spectrometer data storage;

iii. computer instructions in the mass spectrometer data storage to measure a mass to charge ratio of molecular weights for components in fluid samples from the wellbore; and iv. computer instructions in the mass spectrometer data storage to communicate the measured mass to charge ratio in fluid samples from the wellbore to the well fluid processor;

c. at least one rig sensor on a drilling rig, at least one downhole sensor in a wellbore, or the at least one rig sensor on the drilling rig and the at least one downhole sensor in the wellbore connected to the well fluid processor;

d. a third party processor with a third party data storage that receives sensor information from at least one downhole sensor in the wellbore connected to the well fluid processor;

e. computer instructions in the well fluid data storage to form a geochemical well log template;

f. computer instructions in the well fluid data storage to calculate molecular concentrations of molecular species of the fluid samples using the mass to charge ratio measured by the mass spectrometer;

g. computer instructions in the well fluid data storage to calculate a plurality of graphical molecular curves from the calculated molecular concentrations and plotting the plurality of graphical molecular curves into the geochemical well log template;

h. computer instructions in the well fluid data storage to populate the geochemical well log template with user information, well information, and at least one of: engineering information from a third party processor connected to downhole sensors, engineering information from rig sensors, additional fluid analysis information from the at least one total hydrocarbon analyzer, measured values from a carbon dioxide sensor, and measured values from a hydrogen sulfide sensor forming a geochemical well log;

i. computer instructions in the well fluid data storage to transmit the formed geochemical well log to the at least one client device using the networks;

j. computer instructions in the well fluid data storage to edit values of the geochemical surface well log using a pointer and performing the steps of: (i) providing a pattern when the pointer connects with a track; (ii) automatically displaying a selected pattern and a percent value of the selected pattern where the pointer connects with the track; (iii) automatically changing a percent value of the selected pattern by moving the pointer in the track; and (iv) connecting the pointer to an index of the track and inserting the selected pattern into the track by moving the pointer along the index; and k. a remote processor with a remote data storage containing engineering information on equipment in the wellbore to obtain information for populating the geochemical well log template connected to the well fluid processor.

2. The system of claim 1, comprising computer instructions in the well fluid data storage to create at least one graphical drilling track in the geochemical surface well log for the geothermal well, the hydrocarbon well, or the testing well.

3. The system of claim 2, further comprising computer instructions in at least one of the well fluid data storage and a client data storage, to form a plurality of job buttons on the geochemical surface well log comprising:

a. create a new job;

b. open an existing job;

c. restore a job from backup;

d. close an open job;

e. import data into the geochemical surface well log template comprising well sensor data, fluid testing data;

f. export data from the geochemical surface well log template;

g. print the geochemical surface well log;

h. edit the geochemical surface well log;

i. save the geochemical surface well log; and j. exit the geochemical surface well log.

4. The system of claim 2, further comprising computer instructions in the well fluid data storage to change the geochemical surface well log from a plurality of graphical information tracks to a grid view.

5. The system of claim 2, further comprising computer instructions in the well fluid data storage to import pictures into a track of the geochemical well log template.

6. The system of claim 1, comprising: computer instructions in the well fluid data storage for calculating a plurality of well sensor curves using well sensor information, downhole sensor data, and plotting the plurality of well sensor curves into the geochemical surface well log template.

7. The system of claim 6, further comprising computer instructions in the well fluid data storage for scaling at least one of: the plurality of well sensor curves, at least one of a plurality of synthetic curves, and at least one of the plurality of graphical molecular curves.

8. The system of claim 7, comprising computer instructions in the well fluid data storage for calculating ratios using calculated molecular concentrations, forming the plurality of synthetic curves, for the calculated molecular concentrations and plotting the plurality of synthetic curves into the geochemical well log template.

9. The system of claim 8, comprising at least one of the following:

a. computer instructions in the well fluid data storage to identify trends in the plurality of synthetic curves, the plurality of graphical molecular curves, and the plurality of well sensor curves and placing a visual marker across at least one of: the plurality of synthetic curves, the plurality of graphical molecular curves, and the plurality of well sensor curves;

b. computer instructions in the well fluid data storage to create and transmit a first alarm to the at least one client device using the network, identifying when a value in at least one of: the plurality of graphical molecular curves, the plurality of synthetic curves, and the plurality of well sensor curves exceeds or falls below a first user defined preset limit, stored in at least one: the well fluid data storage, and a client device data storage; and c. computer instructions in the well fluid data storage to create and transmit a second alarm to the at least one client device connected to the network when:
   i. at least two graphical molecular curves of the plurality of graphical molecular curves intersect;
   ii. at least two synthetic curves of the plurality of synthetic curves intersect; or
   iii. at least one graphical molecular curve of the plurality of graphical molecular curves and at least one synthetic curve of the plurality of synthetic curves intersect.

10. The system of claim 9, further comprising computer instructions in the well fluid data storage to calculate for at least one of the plurality of graphical molecular curves, well sensor curves and synthetic curves, at least one of the following:

a. a slope;
b. a rate of change for the slope; and
c. a difference between slopes or a difference between rates of change for the slopes to a second user defined preset limit, wherein the second user defined preset limit is in at least one of: the client device data storage and the well fluid data storage and using the difference to determine if an anomaly is present for either: a drilling process, a rock formation, or for a drilling process and a rock formation.

11. The system of claim 10, comprising forming at least one of: a safety interpretation for drilling and economic analysis; a geochemical interpretation for at least one of: mapping regionally, mapping locally, timeline modeling of a geological reservoir, economic analysis, and operations; a geological interpretation for at least one of: drilling, mapping, modeling, operations, and economic analysis; and an engineering interpretation for at least one of: drilling, operations, and economic analysis; in near real time using the geochemical surface well log.

12. The system of claim 1, comprising computer instructions to create an executive dashboard that can present user information on the executive dashboard and well sensor information, and fluid testing information, and into a formed geochemical surface well log in at least one of:

a. a microview log plot comprising:
   i. at least one of: a graphical molecular curve of the plurality of graphical molecular curves, a well sensor curve of the plurality of well sensor curves, and a synthetic curve of the plurality of synthetic curves; and
   ii. at least one of: a measured depth index and a measured time index; and
b. a macroview log plot comprising:
   i. at least one of: a graphical molecular curve of the plurality of graphical molecular curves, a well sensor curve of the plurality of well sensor curves, and a synthetic curve of the plurality of synthetic curves; and
   ii. a compressed view of an entire drilling project at any point in time during drilling and at all the depths of the wellbore.

13. The system of claim 12, having computer instructions that display the macroview plot log and the microview log plot simultaneously on the geochemical surface well log.

14. The system of claim 13, comprising computer instructions in at least one of: a client device data storage and the well fluid data storage to form a track header for the curves, wherein the track header has at least one of:

a. a benzene concentration;
b. a toluene concentration;
c. an ethyl benzene concentration;
d. a xylene concentration;
e. a naphthalene concentration;
f. a naphthene and cylcloalkane concentration;
g. an acetic acid concentration;
h. a nitrogen, oxygen, argon, and water vapor concentration;
i. a carbon dioxide, helium and hydrogen concentration;
j. a sulfur species concentration;
k. a methane concentration (C1);
l. an ethane concentration (C2);
m. a propane concentration (C3);
n. a butane concentration (C4);
o. a pentane concentration (C5);
P. a hexane concentration (C6);
q. a heptane concentration (C7);
r. an octane concentration (C8);
s. a nonane concentrate (C9); and
t. a decane concentration (C10).

15. The system of claim 14, comprising computer instructions in at least one of: the well fluid data storage and the client device data storage, to provide a track header having at least one of:

a. a Pixler ratio;
b. a wetness ratio;
c. a balance ratio;
d. a character ratio; and
e. an air to hydrocarbon ratio.

16. The system of claim 1, comprising:

a. computer instructions in the well fluid data storage to import well event based observational data comprising lithology analysis and drill cuttings analysis from a remote data storage;
b. computer instructions in at least one of: the well fluid data storage and a client device data storage to present the imported well event based observational data as a lithology track; and
c. computer instructions in at least one of the well fluid data storage and the client device data storage to present drill cuttings analysis from the mass spectrometer and the at least one total hydrocarbon analyzer as a graphical drill cuttings track.

17. The system of claim 1, further comprising:

a. computer instructions in the well fluid data storage to allow insertion of lithology observational comments into the geochemical surface well log; and
b. computer instructions in the well fluid data storage to automatically update the geochemical surface well log continuously 24 hours a day, 7 days a week, comprising: at least one of the plurality of graphical molecular curves, the plurality of synthetic curves, the plurality of well sensor curves, engineering data, geological information including lithology observational comments.

18. The system of claim 1, further comprising computer instructions in the well fluid data storage to form color coded comments, wherein the colors are selected to separately indicate at least one of:

a. a trend identification;
b. at least one drill pipe connection;
c. survey comments to authenticate actual survey information or reference actual survey information;
d. a drilling parameter;

e. a gas peak indicated as a text value on the top of each total gas peak;

f. at least one piece of faulty equipment;

g. a dated depth; and h. a gas show.

19. The system of claim 1, comprising computer instructions in at least one of: the well fluid data storage and a client device data storage, to plot on the geochemical surface well log at least one of:

a. a porosity histogram track;

b. a gas graph track;

c. a symbol track;

d. a horizontal line track; and e. a wellbore profile track.

20. The system of claim 1, further comprising computer instructions in the well fluid data storage to import into the operator dashboard downhole sensor data from the third party data storage.

21. The system of claim 1, further comprising computer instructions in the well fluid data storage to import into the geochemical well log and the operator dashboard fluid testing analysis from at least one: (1) the at least one total hydrocarbon analyzer, (2) the carbon dioxide sensor, and (3) the hydrogen sulfide sensor.

22. The system of claim 1, further comprising computer instructions in the well fluid data storage to present a report using the geochemical surface well log.

23. The system of claim 1, further comprising computer instructions in the well fluid data storage to present a sample picture in the geochemical surface well log.

24. The system of claim 1, further comprising computer instructions in the well fluid data storage to form an operator dashboard for viewing analysis from (i) the mass spectrometer analyzer and (ii) the at least one rig sensor to present: a real time depth graphical display; a lag depth graphical display; a lag depth digital display; a hole depth; a mass spectrometer reaction chamber pressure; a current value of analyzed components of a fluid sample; and well sensor information.

* * * * *